United States Patent [19]

Davis et al.

[11] Patent Number: 4,471,878

[45] Date of Patent: Sep. 18, 1984

[54] CHILD AND TAMPER RESISTANT CLOSURE

[75] Inventors: Eugene E. Davis, Essex; Kevin W. McLaren, Kent, both of England

[73] Assignee: Johnsen & Jorgensen (Plastics) Ltd., London, England

[21] Appl. No.: 508,604

[22] Filed: Jun. 28, 1983

[30] Foreign Application Priority Data

Nov. 30, 1982 [GB] United Kingdom ..... 8234136

[51] Int. Cl.[3] ..... B65D 55/02

[52] U.S. Cl. ..... 215/216; 215/258

[58] Field of Search ..... 215/216, 211, 224, 256, 215/258

[56] References Cited

U.S. PATENT DOCUMENTS 4,043,475 8/1977 Wheeler ..... 215/224

4,071,156 1/1978 Lowe ..... 215/224

*Primary Examiner*—George T. Hall

[57] ABSTRACT

The invention provides a closure, for a container, in which the closure is provided with means to engage with the wall of a container when the closure is in operative position so that the closure cannot be removed until the closure and/or the container is manipulated to disengage the closure from the container and in which the closure includes a tamper-resistant band connected to the main part of the closure by frangible means so that the closure cannot be removed initially from the container without first breaking the frangible means.

10 Claims, 4 Drawing Figures

CHILD AND TAMPER RESISTANT CLOSURE

This invention is concerned with the provision of a combined tamper-resistant and child-resistant closure for a container and to a container and closure assembly which is both tamper-resistant and child-resistant.

By a tamper-resistant closure we mean a closure provided with means to indicate that the closure has been removed from the associated container after the container was filled and the closure was first applied to the container. By a child-resistant closure we mean a closure that has to be manipulated in a special way in order that it may be removed from the container by an adult only.

In the past various proposals have been put forward for the provision of tamper-resistant closures and various proposals have been put forward for the provision of child-resistant closures but it has proved to be difficult to provide a closure that combines both features. In fact it has been argued in the past that while it is important to provide a child-resistant closure for example a container of medicament, the provision of a tamper-resistant is not necessary. However recent events in U.S.A. have shown that it is no longer safe to hold such a view and it is an object of the invention to provide a closure that combines the two features.

According to the present invention we provide a closure (for a container) wherein the closure is provided with means to engage with the wall of the container when the closure is in operative position so that the closure cannot be removed until the closure and/or the container is manipulated to disengage the closure from the container and wherein the closure includes a tamper resistant band connected to the main part of the closure by frangible means so that the closure cannot be removed initially from the container without first breaking the frangible means.

In order that the invention may be more clearly understood and readily carried into effect reference is now directed to the accompanying drawings, given by way of example, in which FIG. 1 is a part sectional view of a closure and container assembly, embodying the invention drawn to an enlarged scale as compared with FIG. 2;

Figure 1:
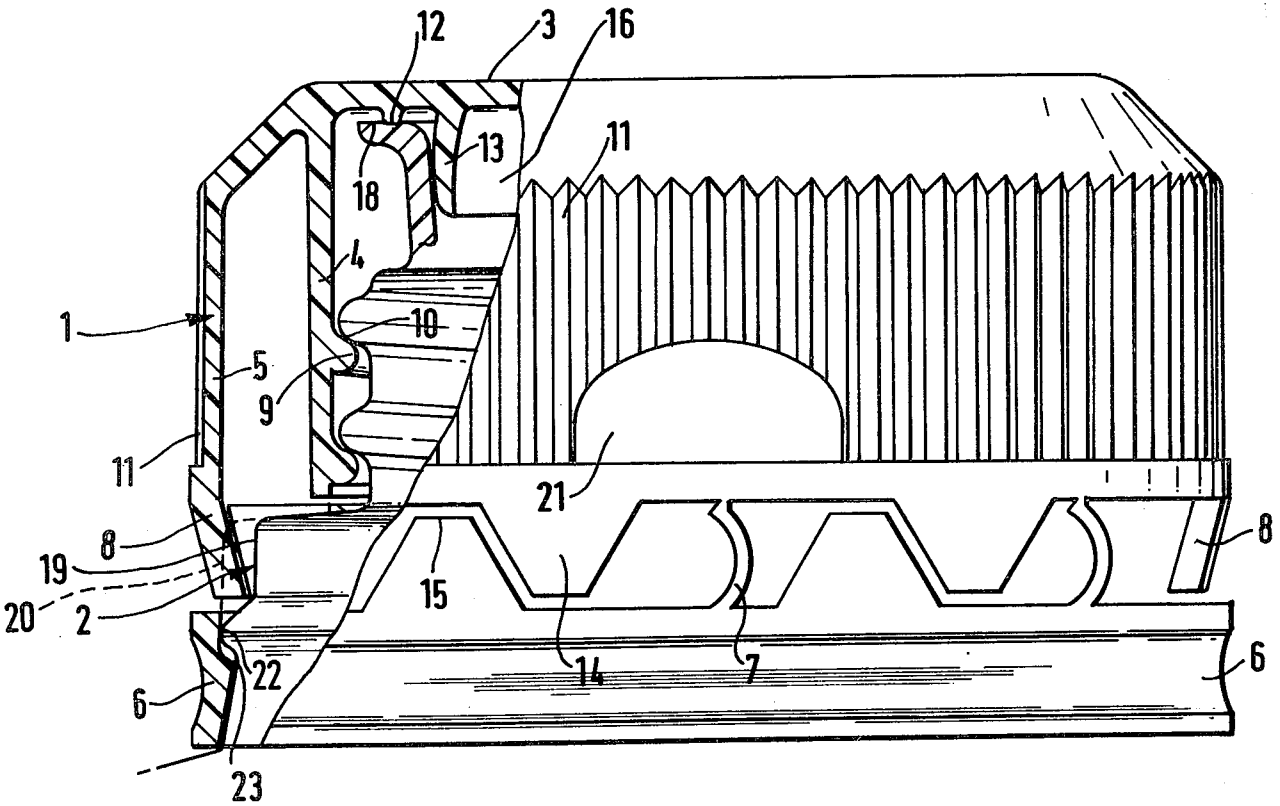
Figure 2:
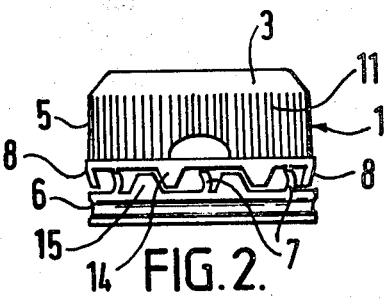
FIG. 2 is a side view of the closure shown, in what could be, the actual size of a closure for example for aspirin tablets.

Referring mainly to FIG. 1 it will be seen that a closure 1 is shown seated in operative position on a container 2. The closure 1 has a top 3, a depending inner skirt 4, a depending outer skirt 5 longer than the inner skirt and a tamper resistant band 6 connected to the bottom of the skirt by frangible tongues 7. The outer skirt has spaced lugs 8, preferably two such lugs arranged diametrically opposite to one another, the lugs 8 being inclined inwardly and downwardly as illustrated. The inner skirt 4 of the closure 1 has a screw-thread 9 for co-operation with a screw-thread 10 on the container 2. The outside surface of the outer skirt 5 is serrated at 11 so that it may be more easily gripped by a user and the closure is also provided with annular bead 12 and a plug portion 13 for sealing purposes. The bottom of the outer skirt 5 has teeth 14 each tooth 14 in the embodiment illustrated being separated from the adjacent teeth by a frangible tongue, or by a tongue and a lug though this precise arrangement is not significant. The band 6 also has teeth 15 for co-operation with the teeth 14 on the skirt.

The container 2 has a mouth 16 and preferably has a neck adjacent to the mouth terminating in a shoulder 17. The neck of the container 2 has the external screw-thread 10 and the top edge of the mouth of the container is turned outwardly to provide a substantially horizontal seating 18 for the bead 12. The container 2 also has horizontally inclined cam surfaces 19 each terminating in shoulders 20. Pads 21 are provided on the closure 1 and are arranged in diametrically opposed positions displaced by substantially 90° from the lugs 8 so that when pressure is brought to bear on the pads 21 the outer skirt 5 of the closure will be deformed and the lugs 8 will be moved outwardly so as to disengage from the shoulders 20 on the container. The tongues 7 are preferably bow shaped when viewed in side elevation to allow the tongues a certain amount of up and down movement without breaking. The container 2 has an annular retaining bead 22 below the cam surfaces 19 and the band 6 has an inner annular ledge 23 which is disposed below the bead 22 when the closure is in operative position. The shape of the ledge 23 is such that the band 6 can slide downwards over the bead 22 when the closure 1 is being put on but resists upward movement when the closure is being taken off. Naturally the bead 22 can be either continuous or discontinuous.

Figure 4:
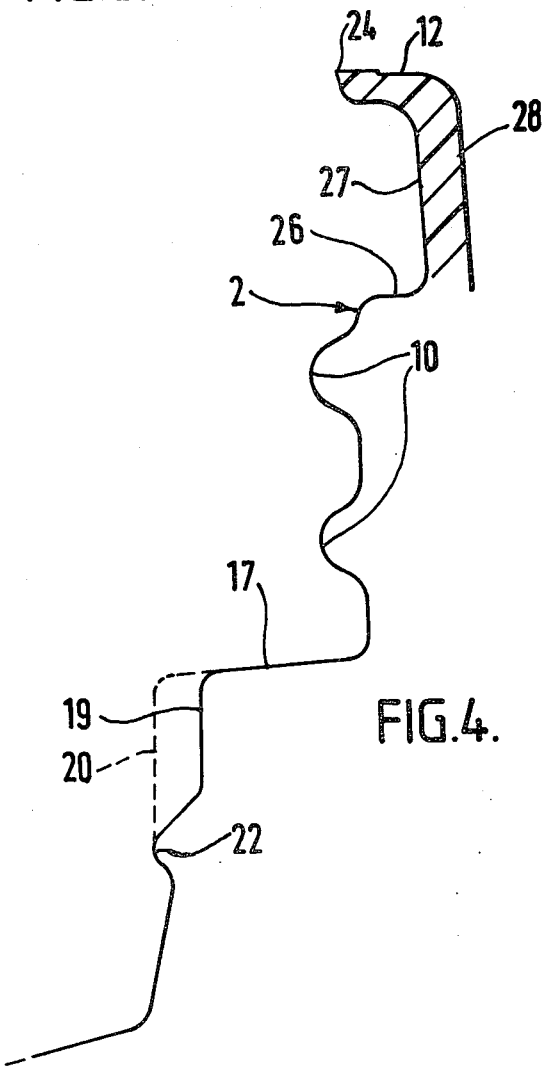
FIG. 4 is a diagrammatic side view of the container neck.

FIG. 4 gives a clear outline of the profile of the container neck in its preferred embodiment. Starting at the top the seating 18 has a pouring lip 24, and below the seating there is a substantially vertically flat section 27 shaped like the letter U on its side bounded at the top and bottom by wall sections 25, 26. The screw thread 10 is below the section 27 and below the thread 10 is the shoulder 17, the cam surfaces 19 with cam shoulders 20, which act as stops, below which is the bead 22. Preferably the container is smooth on the inside as indicated at 28.

Figure 3:
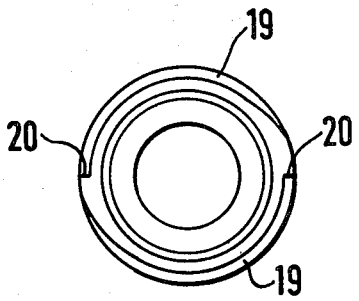
FIG. 3 is a plan view of the container neck.

In operation the closure 1 is applied to the container 2 by screwing it on in the usual way. The lugs 8 run up the cam surfaces 19 in a clockwise direction in FIG. 3 and jump down the cam shoulders 20 until the closure is properly seated on the container 2 as shown in FIG. 1 with the ledge 23 below the bead 22. During this movement the teeth 14 on the lower edge of the outer skirt 5 tend to move to the right and slightly downwards and so make contact with the teeth 15 whereby the band 6 is urged round with the rest of the closure 1 and the tongues 7 remain intact. To remove the closure 1 i.e. to open the container it is necessary to unscrew the closure 1 by turning it counter-clockwise in FIG. 3 but that movement cannot be effective because the lugs 8 abut against the cam shoulders 20. In order to start opening the container effectively it is first necessary to squeeze the pads 21 so that the inward movement of the pads distorts the outer skirt of the closure 1 and moves the lugs 8 outwardly beyond the cam shoulders 20 thus releasing the closure 1 for counter-clockwise turning movement. This is the child-resistant feature of the assembly because a small child will not know the secret of how to free the closure and it is unlikely that a small child would stumble upon the secret accidentally.

When the pads are squeezed and turning of the closure begins the tamper resistant feature comes into play, the teeth 14 tend to move out of contact with the teeth 15 and the outer skirt of the closure tends to rise but the band 6 is restrained from rising because the ledge 23 abuts against the bead 22. This results in the outer skirt 5 rising with the main part of the closure and the band 6 remaining in a fixed position so that the tongues 7 stretch and then break releasing the band 6 from the main part of the closure 1. A closure without a band 6 or with a band separated from the main part of the closure gives evidence that the contents of the container may have been tampered with. The invention has been described by way of example in connection with a screw closure but it can also be applied to a push-on, pull-off cap in which case the lugs 8 will be arranged so that they engage with the container e.g. under a ledge so that the closure cannot be pulled up until the lugs are released by squeezing the pads 21 and the connection of the band 6 to the outer skirt can be the same as in the case of a screw closure, the teeth being omitted. In this arrangement the band will be held in its down position as described above and as the closure is pulled upwards the tongues 7 will break.

It will be understood that although the lugs 8 are shown as being inclined they may if desired be either substantially vertical or substantially horizontal.

We claim:

1. A closure, for a container, wherein the closure is provided with means to engage with the wall of a container when the closure is in operative position so that the closure cannot be removed until the closure and/or the container is manipulated to disengage the closure from the container and wherein the closure includes a tamper resistant band connected to the main part of the closure by frangible means so that the closure cannot be removed initially from the container without first breaking the frangible means, and a depending inner skirt, a depending outer skirt longer than the inner skirt, the tamper resistant band being connected to the bottom of the outer skirt by frangible tongues.

2. A closure according to claim 1 wherein the outer skirt has spaced lugs arranged diametrically opposite one another, the lugs being inclined inwardly and downwardly and the inner skirt having a screw thread for co-operation with a screw thread on the container.

3. A closure according to claim 1 wherein the bottom edge of the outer skirt has teeth for co-operation with teeth on the top edge of the tamper resistant band.

4. A closure according to claim 3 wherein each tooth is separated from the adjacent tooth by a frangible tongue or by a tongue and a lug.

5. A closure according to claim 2 wherein the closure has pressure pads arranged in diametrically opposed positions and displaced by about 90° from the lugs.

6. A closure according to claim 1 wherein the tongues are bow shaped in side elevation.

7. A container and closure assembly including a closure as claimed in claim 1 wherein the container has a mouth, a neck adjacent to the mouth terminating in a shoulder, an external screw thread on the neck and horizontal cam surfaces each terminating in a shoulder, the top edge of the mouth being turned outwardly to provide a substantially horizontal seating for a sealing bead on the closure.

8. A closure, for a container with an open mouth, wherein the closure comprises a top, a depending inner skirt to embrace the outer surface of the container around the mouth, a depending outer skirt longer than the inner skirt to contact the outer surface of the container below the inner skirt, locking means on the outer skirt to engage with the outer surface of the container when the closure is in operative position so that the closure cannot be removed until the closure is manipulated to disengage the locking means in the closure from the container and a tamper resistant band connected to the bottom of the outer skirt by frangible means so that the closure cannot be removed initially from the container without first breaking the frangible means.

9. A closure according to claim 8 wherein the outer skirt has spaced lugs arranged diametrically opposite one another, the lugs being inclined inwardly and downwardly and the inner skirt having a screw thread for cooperation with a screw thread on the container.

10. A closure according to claim 9 wherein the closure has pressure pads arranged in diametrically opposed positions and displaced by about 90° from the lugs.

* * * * *